US007364058B2

(12) United States Patent
Bartolone et al.

(10) Patent No.: US 7,364,058 B2
(45) Date of Patent: Apr. 29, 2008

(54) TICKET DISPENSING APPARATUS

(75) Inventors: Anthony Bartolone, Cumming, CA (US); Joe Cicocki, Newark, DE (US)

(73) Assignee: Scientific Games International, Inc., Alpharetta, GA (US)

( * ) Notice: Subject to any disclaimer, the term of this patent is extended or adjusted under 35 U.S.C. 154(b) by 76 days.

(21) Appl. No.: 10/883,566

(22) Filed: Jul. 1, 2004

(65) Prior Publication Data

US 2005/0056675 A1 Mar. 17, 2005

(51) Int. Cl.
*G07B 3/02* (2006.01)

(52) U.S. Cl. ..... 225/106; 225/93

(58) Field of Classification Search ..... 225/106, 225/4, 10, 100, 93; 192/41 R; 235/31 R, 235/31 T; 226/138, 143, 144, 145, 190, 226/186; 400/621
See application file for complete search history.

(56) References Cited

U.S. PATENT DOCUMENTS

| | | | | |
|---|---|---|---|---|
| 1,905,659 A | | 4/1933 | Thomson | |
| 2,084,986 A | * | 6/1937 | Black et al. | 101/227 |
| 2,219,650 A | | 10/1940 | Helsel | |
| 2,252,720 A | | 10/1941 | Metzner | |
| 2,325,054 A | | 7/1943 | Helsel | |
| 2,331,316 A | | 10/1943 | Freedman | |
| 2,776,007 A | | 1/1957 | Dietz et al. | |
| 2,795,875 A | | 6/1957 | Nutter | |
| 2,896,531 A | | 7/1959 | Woodrow | |
| 2,970,784 A | | 2/1961 | Kessler | |
| 2,980,307 A | | 4/1961 | Crane | |
| 3,064,785 A | | 11/1962 | Weingart | |
| 3,329,807 A | | 7/1967 | Currie | |
| 3,412,913 A | | 11/1968 | Palter | |
| 3,481,520 A | | 12/1969 | Pickering | |
| 3,501,622 A | | 3/1970 | Syzmanski | |
| 3,794,228 A | | 2/1974 | Colwell et al. | |
| 3,894,669 A | | 7/1975 | Wescoat | |
| 4,094,451 A | | 6/1978 | Wescoat | |
| 4,202,468 A | | 5/1980 | Anderson | |
| 4,284,221 A | | 8/1981 | Nagel et al. | |
| 4,397,410 A | | 8/1983 | Schueler | |
| 4,430,914 A | * | 2/1984 | Keim | 83/35 |
| 4,515,321 A | | 5/1985 | Kahlman | |
| 4,586,639 A | | 5/1986 | Ruff et al. | |
| 4,688,708 A | | 8/1987 | Irvine et al. | |
| 4,697,726 A | | 10/1987 | Gaucher | |
| 4,730,762 A | | 3/1988 | Felix | |
| 4,844,369 A | | 7/1989 | Kanayachi | |
| 4,982,337 A | | 1/1991 | Burr et al. | |

(Continued)

*Primary Examiner*—Stephen Choi
(74) *Attorney, Agent, or Firm*—Smith Gambrell & Russell LLP

(57) ABSTRACT

An improved ticket dispensing apparatus to efficiently and expeditiously control the separation and dispensing of tickets from a continuous strip of tickets. Once a ticket selection is made, a control circuit activates the dispensing mechanism for dispensing the selected number of tickets. The strip of tickets is drawn into engagement with a pair of drive rollers and forced into engagement with a downstream deflector plate. Once a measured and predetermined ticket length has been met, the direction of movement for the drive rollers is reversed and a unidirectional clutch engaged. The clutch rotates a deflector plate used to force the strip of tickets into engagement with a stationary cutting blade along a perforated line scored in the ticket strip so that the desired number of tickets are separated from the ticket strip.

11 Claims, 5 Drawing Sheets

U.S. PATENT DOCUMENTS 5,113,758 A 5/1992 Chou
5,133,615 A 7/1992 Saito et al.
5,160,076 A 11/1992 Ford
5,215,383 A 6/1993 Hilton
5,222,624 A 6/1993 Burr
5,239,904 A * 8/1993 Yamaguchi et al. ..... 83/210
5,503,318 A 4/1996 Chou
5,833,104 A 11/1998 Horniak et al.
5,836,498 A 11/1998 Turek
5,927,583 A 7/1999 Kyle
5,950,898 A 9/1999 Menna
6,386,080 B1 * 5/2002 Okamoto et al. ..... 83/73
6,609,644 B1 8/2003 Menna
6,669,071 B1 12/2003 Menna
2004/0200874 A1 * 10/2004 Menna ..... 225/106

* cited by examiner

TICKET DISPENSING APPARATUS

FIELD OF THE INVENTION

The present invention relates to ticket dispensing machines generally. More particularly, the invention relates to a lottery ticket dispensing machine.

BACKGROUND OF THE INVENTION

As known, there are two basic types of lotteries that are most commonly played, these being instant win or scratch off lottery games and on-line games. The instant win type of games provide a scratch-off ticket that enables the player to scratch off a masked area overlying imaged and predetermined game data on the ticket to immediately reveal the game result and prize. On-line lotteries permit lottery players to select, or have selected for them, a series of numbers such that the ticket is a winner if all or certain number combinations match all or at least a predetermined number of the numbers or game indicia selected during the lottery drawing.

The instant win lottery games remain popular, and have seen increased demand due to the number and variety of instant win lottery games now available for play. Instant win games have traditionally been dispensed by a sales clerk grasping a portion of a leading ticket extended from a manual ticket dispenser, pulling the desired number of tickets therefrom, and then bending and tearing the tickets to be purchased along a perforation line to separate the tickets from the remainder of the ticket book or pack. This can take a significant amount of time, especially over the course of a sales shift, and may also lead to errors in handling and charging for the tickets as well as being a distraction to the sales clerk's performance of their other duties at the retail establishment in which they are employed, which is typically a convenience type of store. In response to this need for a simpler and more efficient means for dispensing instant win tickets, the dispensing devices of U.S. Pat. Nos. 6,669,071, 6,609,644, and 5,950,898, respectively, were developed.

Although the dispensing devices of these patents represented a significant advance in the art, there remains a need for a simple ticket dispensing device offering increased manufacturing efficiencies and cost reductions, coupled with the ease of use and reliability of the aforementioned dispensing devices.

SUMMARY OF THE INVENTION

The present invention satisfies the demands of lotteries and lottery retailers by providing an improved instant win lottery ticket dispensing apparatus having an integral mechanical clutch as part thereof. Accordingly, in a preferred embodiment of the invention a dispensing mechanism for dispensing at least one ticket from a continuous strip of perforated tickets, the strip of tickets having a series of spaced perforation lines parallel to one another for defining separate ones of the tickets, is disclosed. The dispensing mechanism includes a pair of spaced drive rollers used to selectively advance the strip of tickets along a path of travel through the ticket dispenser in a first direction as well as in a second reverse direction, a cutting blade positioned along the path of travel, a clutch assembly operably coupled to the drive rollers. The clutch assembly is inactive in the first direction and operable in the second direction.

The dispensing mechanism has a planar deflector plate operably coupled to the clutch assembly and positioned with respect to the cutting blade. The deflector plate is movable from a first position in the first direction of ticket movement into a second position in the second direction of movement. As the strip of tickets is moved in the second direction by the drive rollers the clutch assembly moves the deflector plate from its first position into its second position such that the deflector plate bends the strip of tickets backwards along a perforated line therein toward the cutting blade for positioning that perforated line thereat.

The dispensing mechanism has a drive motor coupled to a first one of the drive rollers for rotating the roller, and is used to control the movement of the strip of tickets in the first and the second directions. A control circuit is connected to the drive motor and is used to direct the operation of the drive motor. A sensor is positioned along the path of travel and is connected to the control circuit to indicate the position of the strip of tickets along the path of travel.

The present invention also provides a method of separating at least one ticket from a continuous strip of perforated tickets. The method includes the steps of advancing the strip of tickets along the path of travel in the first direction, engaging a deflector plate with the strip of tickets so as to bend the strip back toward a cutting blade, reversing the direction of the strip of tickets along the path of travel into the second direction, engaging a clutch assembly coupled to the drive rollers once the tickets move in the second direction, the clutch assembly moving the deflector plate from a first position into a second position in order to bend the strip of tickets against the cutting blade and engaging the cutting blade with the tickets along one of the perforated lines so as to separate at least one ticket from the strip of tickets.

Accordingly, the improved ticket dispensing mechanism of the present invention may be used to efficiently and expeditiously control the dispensing of tickets, and in particular instant win lottery game tickets.

BRIEF DESCRIPTION OF THE DRAWINGS

A ticket dispensing apparatus embodying the features of the present invention is depicted in the accompanying drawings which form a portion of this disclosure, wherein.

DESCRIPTION OF THE PREFERRED EMBODIMENTS

Figure 1:
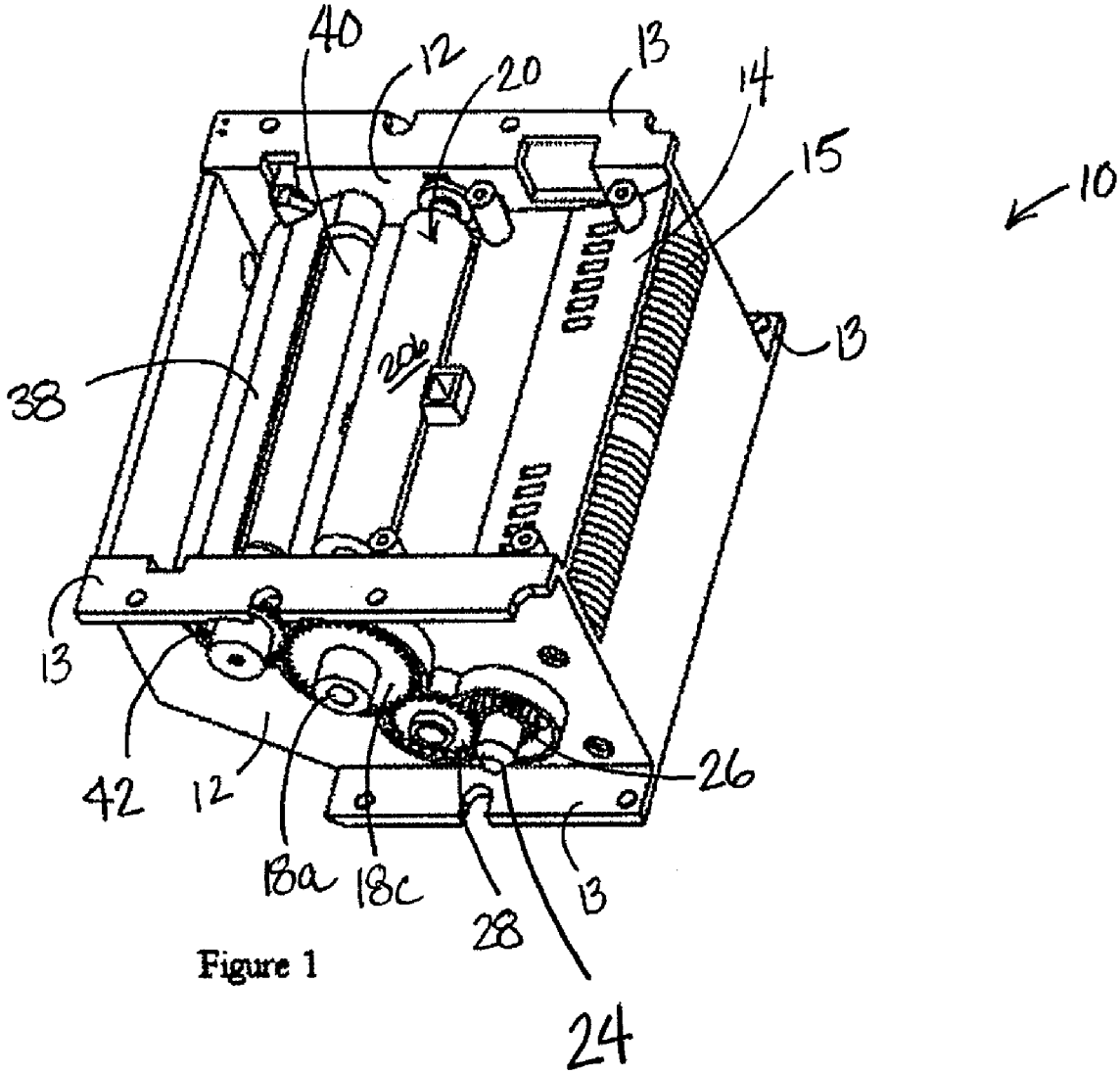
FIG. 1 is a top, perspective view of a ticket dispensing mechanism of the present invention.

Referring now in detail to the to the drawings, in which like reference characters indicate like parts throughout the several views, a ticket dispensing mechanism 10 of the present invention is illustrated in FIGS. 1-5. As will hereinafter be more fully described, the instant invention is operable for dispensing a continuous perforated sheet or strip of game or promotional tickets 16, such as a predetermined number of instant win or scratch off lottery tickets, of known construction.

Referring now to FIG. 1, the ticket dispensing mechanism 10 includes a housing formed at least partially by pair of spaced and parallel support plates 12. Each of the support plates 12 is formed to have at least one elongate flange 13 extended along two opposed side edges thereof for use in attaching the ticket dispensing mechanism, and in particular the housing thereof, to the frame of a ticket vending machine, for example, or as otherwise required or desired for mounting the dispensing mechanism for use. A planar feed guide 14 is provided which extends between and is affixed to the two support plates 12, and which is spaced from and positioned to be approximately parallel to a lower, ticket-engaging surface 15 defining a small gap for guiding the insertion of the strip of tickets therebetween.

The dispensing mechanism also includes a pair of spaced and parallel gear driven pinch rollers 18, 20 which extend between and are rotatably supported on the two spaced support plates. A drive motor 22, which may comprise a stepper motor, a servo motor or other known types of drive motors capable of discrete movement, as desired, is positioned proximate one of the support plates 12 and is spaced from, and in this instance beneath, the feed guide 14. Operation of the drive motor 22 is directed by a control circuit 23, such as a computer driven printed circuit board or other known types of drive or control circuits in communication with suitable drive inputs, for example a computer or control processor. The drive motor 22 rotates a gear shaft 24 (FIG. 1) which in turn engages a drive gear 26. The drive gear meshes with a transitional driven gear 28, which in turn drives a first pinch roller gear 18*c* affixed to an end of the first pinch roller 18 for rotation of a pinch roller shaft 18*a*. The second pinch roller 20 is mounted on and extends between the support plates 12 proximate the first pinch roller 18, and tangentially engages the exterior lengthwise surface of the first pinch roller 18 to be driven by, and in the opposite direction of, the first pinch roller. Although the pinch rollers 18, 20 are described as being cooperatively gear driven, it is anticipated that each pinch roller could be individually gear driven or shaft driven, as known and as desired.

Figure 2:
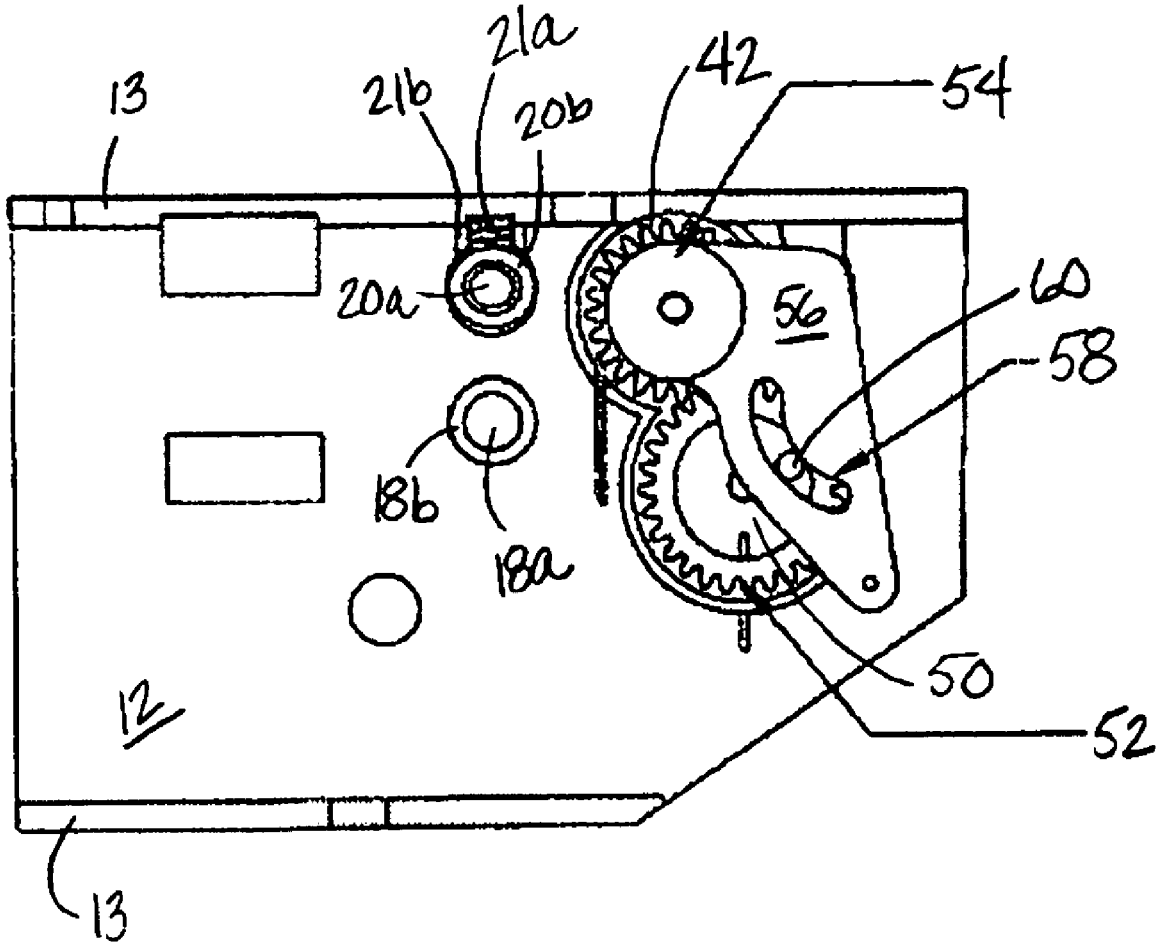
FIG. 2 is a side elevational view of the ticket dispensing mechanism of FIG. 1.

Referring now to FIG. 2, both the first pinch roller 18 and the second pinch roller 20 may be conventionally mounted between the support plates 12 in a number of known ways, one such way being by a pair of bearing blocks (not illustrated) manufactured of known materials, such as a ferrous material, a non-ferrous material, or an engineering plastic. In such a mounting arrangement, the bearing blocks will be sized and shaped to receive opposite ends of the shaft 18*a*, 20*a* of the respective first or second pinch roller 18, 20 in correspondingly sized and shaped circular openings. Referring to the figures, each bearing block associated with the pinch roller 20 may be fitted with a spring 21*a* disposed within corresponding openings 21*b* defined in the support plates 12 so that the shaft 20*a* of the second pinch roller 20 will rotate within the openings in each respective bearing block. A similar configuration may be had for the first pinch roller 18, although not illustrated in the figures. The first and second pinch rollers 18, 20 also have a corresponding padded or cushioned surface 18*b*, 20*b* formed about the exterior periphery of the roller and extending in the lengthwise direction thereof for engagement with a similarly formed surface on the exterior of the first pinch roller 18 when the drive motor 22 is in operation.

Figure 3:
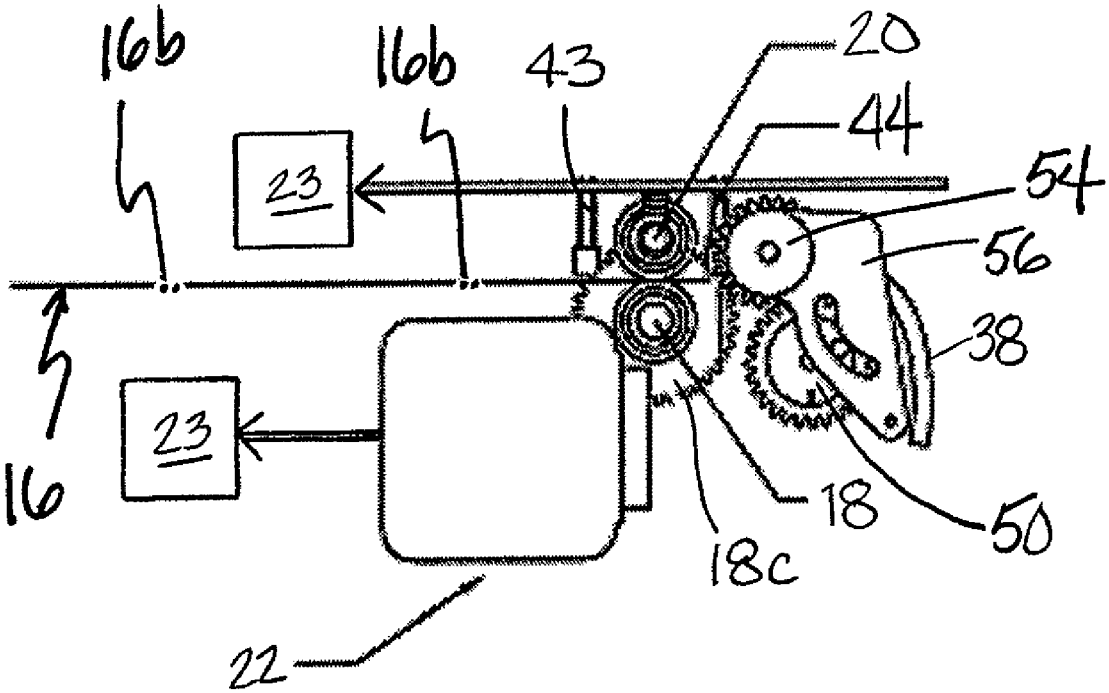
FIG. 3 is a side elevational view of the ticket dispensing mechanism of FIG. 2 with a support plate removed from view.

Looking to FIG. 3, a ticket input sensor 43 is illustrated, which sensor may be mounted in any number of ways to the housing, for example by being carried or supported on one of the support plates 12. A burst and load sensor 44 is also provided, and is mounted on the housing in suitable fashion, proximate the second pinch roller 20. The sensors 43 and 44 are each positioned along a ticket path of travel passing within and through the housing, and are operable for detecting a leading edge 16*a* (FIG. 4) of the tickets 16. The sensors 43, 44 thereby send a corresponding signal to a control circuit 23, which in turn directs the drive motor 22 of the ticket dispensing mechanism 10 in either a forward or reverse direction. The control circuit 23 is in communication with and operably coupled to the drive motor 22 and the sensors 43, 44, and is programmed with predetermined information regarding the size, shape and the number of tickets 16 to be dispensed, to include the leading edge to trailing edge ticket length between perforations 16*b* of the respective tickets in the direction of the path of travel.

Figure 4:
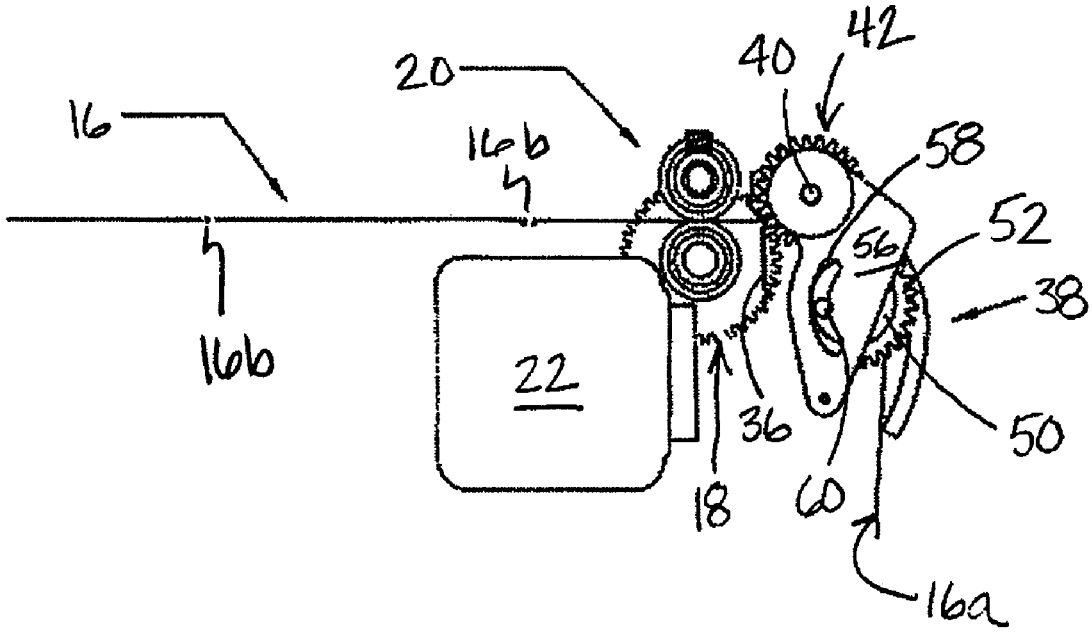
FIG. 4 is a side elevational view of the ticket dispensing mechanism of FIG. 3, with a deflector plate moved into an open position.
Figure 5:
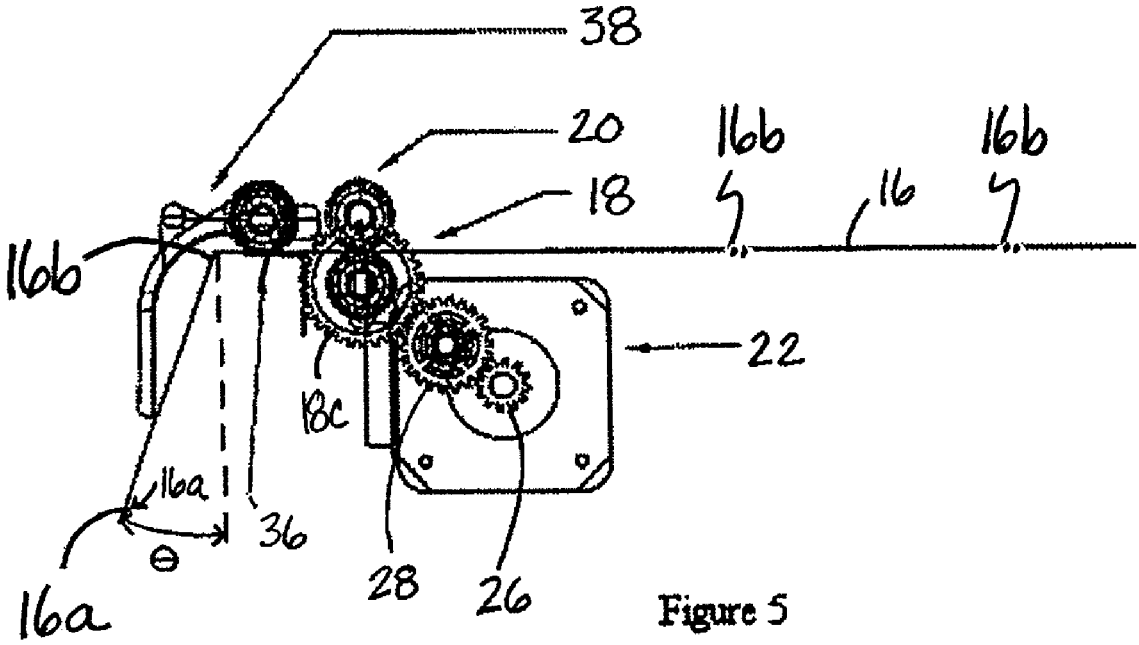
FIG. 5 is a second side elevational view of the ticket dispensing mechanism of FIG. 1 with a support plate removed from the view.

As shown in FIGS. 4 and 5, the ticket dispensing mechanism 10 also includes a cutting blade 36 mounted between the support plates 12 and adjacent the pinch rollers 18, 20. A deflector plate 38 is pivotally carried on an intermediate gear shaft 40 that also extends between the support plates 12 such that the deflector plate 38 is positioned proximate the cutting blade 36. An intermediate gear 42 is attached to one end of the intermediate gear shaft 40 and meshes with the first pinch roller gear 18*c*. In addition, a deflector plate gear shaft 50 extends between the support plates 12 proximate the intermediate gear shaft 40. The deflector plate gear shaft 50 is provided with a deflector plate gear 52 attached thereto, and the intermediate gear 42 meshes with the deflector plate gear 52 to provide the desired rotation of the deflector plate gear shaft 50.

The method by which the dispensing mechanism will dispense the tickets 16 is now described. Initially, the tickets 16 are fed into the dispensing mechanism from a storage bin (not illustrated) or other storage device, and travel along the path of travel through the ticket dispensing mechanism 10 for engagement with the pinch rollers 18, 20. The drive motor 22 controls the rotation of the pinch rollers 18, 20 used to advance or drive the ticket strip through the dispensing mechanism 10 along the path of travel. The ticket input sensor 43 and burst and load sensor 44 are each positioned along the path of travel such that they monitor the position of the ticket strip, and in particular, the leading edge 16*a* thereof.

The sensors 43, 44 are in electrical communication with the control circuit 23, and provide feedback to the control circuit regarding the position of the ticket strip. Once the ticket strip is positioned between the two pinch rollers 18, 20, the ticket strip is then advanced over the stationary cutting blade 36 following the contour of the deflector 38 and continues on past the apex edge of the cutting blade 36 until the strip of tickets 16 reaches a predetermined distance as determined by the control circuit 23 using the signals from the sensors 43, 44.

A unidirectional clutch 54 is connected to the end of the intermediate gear shaft 40, with a deflector plate cam 56 operably coupled to the clutch 54. Additionally, the deflector plate 38 is mechanically connected to the deflector plate cam 56 as shown in FIGS. 3 and 4. The deflector plate cam 56 has a camming surface 58 defined thereon, which is illustrated as an aperture traversing the deflector plate cam 56. A cam follower 60 is mounted to an end of the deflector plate gear shaft 50 (FIG. 2), and traverses the aperture to contact the camming surface 58.

In operation, the unidirectional clutch 54 is affixed on the intermediate gear shaft 40 such that movement of the intermediate gear shaft 40 in a first direction will not influence movement of the clutch 54, i.e., the clutch 54 is not operated. However, movement of the intermediate gear shaft 40 in a second reverse direction will cause the clutch to rotate in that second direction as well. When the clutch 54 is free to move, the deflector plate cam 56 is also free to move. As the deflector plate gear shaft 50 continues its rotation, the attached cam follower 60 (FIG. 4) will move about the camming surface 58 of the deflector plate cam 56. This movement of the cam follower 60, in conjunction with the freedom of movement of the deflector plate cam 56, will cause the deflector plate cam 56 to pivot, carrying the cam follower with it, such that the deflector plate 38 will concomitantly pivot toward the cutting blade 36 to engage the strip of tickets 16 and bend the ticket strip, preferably along one of the spaced perforated lines of ticket separation, back toward and ultimately into engagement with the cutting blade 36.

The drive motor 22 is driven in an open loop mode to control movement of the first and second pinch rollers 18, 20. When the ticket input sensor 43 detects the presence of a ticket 16, the drive motor 18 is energized to thereby drive the pinch rollers 18, 20 and pull the leading edge 16*a* of the ticket or tickets 16 between the feed guide 14 and the pinch rollers 18, 20 into the ticket dispensing mechanism to a "load position." The load position is predetermined according to the length of each ticket 16, measured between the leading ticket edge perforation and the trailing ticket edge perforation, and is monitored by the ticket input sensor 43 and the burst and load sensor 44, this signaled information being stored within the control circuit 23.

Upon instruction by the control circuit 23, the strip of tickets 16 is then moved, using an open loop control mode, to the predetermined cut position as directed by the control circuit 23. In one embodiment, the perforation between the tickets 16 will be approximately 0.25 inches past the stationary blade 36. At this point, the deflector plate 38 is in the open position shown in FIG. 3.

Upon receiving the appropriate instructions from the control circuit 23, the drive motor 22 is then energized to operate in the reverse direction, which thus causes the intermediate gear shaft 40 to rotate in the reverse direction. As the clutch 54 is connected to the intermediate gear shaft 40, the clutch 54 will rotate as the intermediate gear shaft rotates in the reverse direction. This results in the cam follower 60 riding along the camming surface 58 of the deflector plate cam 56, which in turn causes the deflector plate 38 to pivot to a "closed position." When the deflector plate 38 is in its closed position, it will force the ticket 16 to bend along a perforation line 16*b* (FIG. 5) scored in the ticket strip at an acute angle θ with respect to the stationary blade 36 (FIG. 5), such that the perforation 16*b* of the ticket 16 will be engaged with the stationary blade 36. As the drive motor 22 continues its reverse movement, the adjoining tickets 16 will be separated at the line of weakness, i.e., the perforation lines 16*b* through its forced contact with the stationary cutting blade 36. Therefore, by pivoting the deflector plate 38 to engage the tickets 16, the ticket dispensing mechanism 10 is able to obtain a clean and efficient separation of the ticket 16 along the perforation line 16*b* which thus allows the now separated ticket 16 to be passed from the ticket dispensing mechanism 10 as desired.

The burst and load sensor 44 monitors the reverse movement of the ticket strip 16 to determine when the desired ticket has been separated from the remaining ticket stock. The burst and load sensor 44 will send a corresponding signal to the control circuit 23, and the control circuit 23 will in turn direct the drive motor 22 to reposition the new leading edge 16*a* of the remaining ticket stock 16 to the "load position." The control circuit 23 will then await instructions from the dispensing mechanism operator to separate and dispense the next ticket 16 from the ticket dispensing mechanism 10. Upon receipt of the user's instructions, the control circuit 23 will once again activate the drive motor 22 to distribute the desired ticket or tickets 16 following the method described above.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings.

What is claimed is:

1. A dispensing mechanism for dispensing at least one ticket from a continuous strip of perforated tickets, the strip of tickets having a series of spaced perforation lines parallel to one another for defining separate ones of the tickets, the mechanism comprising:

a pair of pinch rollers for selectively advancing the strip of tickets along a path of travel in a first direction and a second reverse direction;

a pinch roller gear connected to one of the pinch rollers;

a cutting blade positioned adjacent the pinch rollers proximate the path of travel of the strip of tickets;

a clutch connected to an intermediate gear shaft, the clutch selectively engaging the pinch roller gear connected to the respective pinch roller, the clutch being inactive in the first direction and operable in the second reverse direction;

a deflector plate cam connected with the clutch;

a deflector plate coupled to the deflector plate cam, the deflector plate positioned proximate the cutting blade in a forward position opposite said pinch rollers to alter the path of travel of the strip of tickets with respect to the cutting blade, the deflector plate being movable from a first position in the first direction to a second position in the second reverse direction;

wherein as the strip of tickets is moved in the second reverse direction by the pinch rollers, the clutch allows the deflector plate cam to pivot, and the deflector plate is moved from the first position into the second position such that the deflector plate bends the strip of tickets backwards toward the cutting blade to engage one of the perforation lines with the cutting blade.

2. The dispensing mechanism of claim 1 comprising a drive motor coupled to at least one of the pinch rollers for rotating the pinch roller, the drive motor controlling the movement of the continuous strip of tickets in the first direction and the second reverse direction.

3. The dispensing mechanism of claim 2 comprising a control circuit connected to the drive motor, the control circuit directing the operation of the drive motor.

4. The dispensing mechanism of claim 3 comprising a sensor positioned along the path of travel and being connected to the control circuit to indicate the position of the strip of tickets along the path of travel.

5. A dispensing mechanism for dispensing at least one ticket from a continuous strip of tickets having a series of spaced-apart lines of weakness, the lines of weakness defining separate ones of the tickets, the mechanism comprising:

a means for driving the strip of tickets along a path of travel in a first direction and a second reverse direction;

a means for separating the at least one ticket from the continuous strip of tickets, the separating means positioned near the driving means along the path of travel of the strip of tickets;

a clutch assembly operably coupled to the means for driving the strip of tickets, the clutch assembly being inactive in the first direction and operable in the second reverse direction;

a deflector plate cam coupled with the clutch assembly;

a deflecting plate connected to the deflector plate cam for deflecting the continuous strip of tickets, the deflecting plate positioned adjacent the separating means in a position forward of the separating means to alter the path of travel of the strip of tickets with respect to the separating means, the deflecting plate being movable from a first position in the first direction to a second position in the second reverse direction;

wherein as the strip of tickets is moved in the second reverse direction by the drive means, the clutch assembly shifts the deflecting plate cam and attached deflecting plate from the first position into the second position such that the deflecting means bends the strip of tickets backwards toward the cutting means to engage one of the perforation lines with the separating means.

6. The mechanism of claim 5, wherein the means for driving comprises a pair of spaced pinch rollers.

7. The mechanism of claim 6, wherein the means for driving comprises a drive motor coupled to at least one of the pinch rollers.

8. The mechanism of claim 7, further comprising a control circuit connected to the drive motor, the control circuit directing the operation of the drive motor.

9. The dispensing mechanism of claim 8, further comprising a sensor positioned along the path of travel and being in electrical communication with the control circuit for indicating the position of the strip of tickets along the path of travel.

10. The mechanism of claim 5, wherein the means for separating comprises a cutting blade positioned along the path of travel.

11. The mechanism of claim 5, wherein the means for deflecting comprises a deflector plate.

* * * * *